US010773367B2

(12) United States Patent
Huang et al.

(10) Patent No.: US 10,773,367 B2
(45) Date of Patent: Sep. 15, 2020

(54) NAIL BLOCKING MEMBER FOR NAIL GUN

(71) Applicant: EVERWIN PNEUMATIC CORPORATION, Taichung (TW)

(72) Inventors: Wen-Sheng Huang, Taichung (TW); Wei-Jen Chen, Taichung (TW)

(73) Assignee: EVERWIN PNEUMATIC CORPORATION, Taichung (TW)

( * ) Notice: Subject to any disclaimer, the term of this patent is extended or adjusted under 35 U.S.C. 154(b) by 205 days.

(21) Appl. No.: 15/967,198

(22) Filed: Apr. 30, 2018

(65) Prior Publication Data

US 2019/0329391 A1 Oct. 31, 2019

(51) Int. Cl.

| | |
|---|---|
| ***B25C 5/02*** | (2006.01) |
| ***B25C 13/00*** | (2006.01) |
| ***B25C 1/18*** | (2006.01) |
| ***B25C 7/00*** | (2006.01) |
| *B21J 15/02* | (2006.01) |
| *B21J 15/04* | (2006.01) |

(52) U.S. Cl.

CPC ..... *B25C 13/00* (2013.01); *B25C 1/188* (2013.01); *B25C 5/02* (2013.01); *B25C 7/00* (2013.01); *B21J 15/025* (2013.01); *B21J 15/04* (2013.01); *B25C 5/0207* (2013.01); *B25C 5/0257* (2013.01); *B25C 5/0292* (2013.01)

(58) Field of Classification Search

CPC ..... B25C 5/02; B25C 5/0207; B25C 5/0257; B25C 5/0292; B25C 7/00; B25C 7/04; B25C 7/09; B21J 15/025; B21J 15/04; B21J 15/32

USPC ..... 227/119, 134, 51, 61, 153, 155; 72/476

See application file for complete search history.

(56) References Cited

U.S. PATENT DOCUMENTS

| | | | | | |
|---|---|---|---|---|---|
| 1,787,285 | A | * | 12/1930 | Polzer | B25C 5/0207 227/155 |
| 2,468,715 | A | * | 4/1949 | Numbers | B25C 5/0207 227/155 |
| 2,687,522 | A | * | 8/1954 | Juilfs | B25C 5/0292 227/124 |
| 3,777,966 | A | * | 12/1973 | Green | B21J 15/04 227/61 |
| 3,871,227 | A | * | 3/1975 | Tidwell, Jr. | B27F 7/04 72/476 |
| 5,095,590 | A | * | 3/1992 | Schick | F16G 3/04 198/844.2 |
| 5,476,204 | A | * | 12/1995 | Eisenpresser | A41H 37/00 227/119 |

(Continued)

*Primary Examiner* — Scott A Smith

(74) *Attorney, Agent, or Firm* — Muncy, Geissler, Olds & Lowe, P.C.

(57) ABSTRACT

A nail blocking member for a nail gun. The nail gun includes a firing portion for firing a nail. When an object is pressed upon the nail blocking member by the firing portion, the nail is fired by the firing portion to enter the object. The nail blocking member includes a main body having a contact face, with a formation groove concavely disposed on the contact face, and a guiding block protruding from the formation groove. An object is pressed upon the contact face by the firing portion, and a nail is fired by the firing portion to enter the object to hit the guiding block, such that the nail is guided by the guiding block to move toward the formation groove, so as to be bent along the formation groove and reversely folded back into the object.

9 Claims, 6 Drawing Sheets

(56) References Cited

U.S. PATENT DOCUMENTS

| | | | | |
|---|---|---|---|---|
| 6,237,827 | B1 * | 5/2001 | Reckelhoff | B25C 5/0292 227/130 |
| 6,918,222 | B2 * | 7/2005 | Lat | B25C 5/0257 411/470 |
| 6,968,939 | B1 * | 11/2005 | Mauer | B21J 15/025 198/468.8 |
| 2014/0209657 | A1 * | 7/2014 | Huang | B27F 7/09 227/19 |
| 2015/0102086 | A1 * | 4/2015 | McCardle | B25C 7/00 227/155 |

* cited by examiner

NAIL BLOCKING MEMBER FOR NAIL GUN

BACKGROUND OF THE INVENTION

1. Field of the Invention

The present invention relates to nail guns, and more particularly, to a nail blocking member for nail gun.

2. Description of the Related Art

In a pallet factory, a large amount of nailing operations are carried out, such that the staff apply a nail gun for executing the nailing operation.

Referring to FIG. 1 and FIG. 2, a nail gun 1 includes a firing portion 3 for firing a nail 2. The user applies the firing portion 3 to press two stacked boards 4 upon the nail blocking member 5. When the firing portion 3 fires the nail 2 to the stacked boards 4, the nail 2 passes through the stacked boards 4, so as to be bent into a J form due to the blockage of the nail blocking member 5. Therefore, the nail 2 is fixed on the stacked boards 4.

The surface 6 of a conventional nail blocking member 5 is formed in a plane shape. The stacked boards 4 are pressed upon the surface 6 of the nail blocking member 5 by the firing portion 3. However, the nail 2 is fired by the firing portion 3 along a random radial direction. When the nail 2 hits the surface 6 of the nail blocking member 5, due to the random radial firing direction, the bending angle of the nail 2 may not conform to the desired bending orientation. Therefore, the nail 2 is possibly bent into a shape other than the desired J shape.

If the nail 2 is not bent into the J shape, as a result, the stacked boards 4 are unable to be completely combined, such that the nail 2 may possibly be detached from the stacked boards 4, causing the stacked boards 4 to be not usable. In addition, with the bent nail 2 projecting from the stacked boards 4, injuries might be caused upon the transporters of the stacked boards.

SUMMARY OF THE INVENTION

For improving the issues above, an embodiment of the present invention discloses a nail blocking member for nail gun. When the nail passes through the object to hit the guiding block, the guiding block guides the nail to move along the formation groove, such that the nail is bent along the formation groove. Therefore, by use of the guiding block and the formation groove, the nail is allowed to be bent into the desired shape and fixed on the object.

For achieving the aforementioned objectives, a nail blocking member for nail gun in accordance with an embodiment of the present invention is provided. The nail gun includes a firing portion for firing a nail. When an object is pressed upon the nail blocking member by the firing portion, the nail is fired by the firing portion of the nail gun, so as to pass through the object. The nail blocking member includes:

a main body provided with a contact face, with a formation groove concavely disposed on the contact face, and a guiding block protruding from the formation groove, wherein an object is pressed upon the contact face by the firing portion, and a nail is fired by the firing portion to enter the object to hit the guiding block, such that the nail is guided by the guiding block to move toward the formation groove, so as to be bent along the formation groove and reversely folded into the object.

With such configuration, when the nail is fired by the firing portion, the guiding block guides the nail to the formation groove, and the nail is bent along the formation groove. Therefore, the issue of the nail unable to be bent in a desired manner when hitting the plane shaped nail blocking member is resolved In an embodiment of the present invention, a guiding face is disposed inclined to connect the guiding block and the formation groove. Therefore, the nail is able to move to the formation groove along the inclined guiding face, so as to be smoothly bent.

In an embodiment of the present invention, a transition face is disposed inclined to connect the formation groove and the contact face. Therefore, the nail is able to be folded back into the object along the transition face, so as to increase the bending effect of the nail.

In an embodiment of the present invention, the formation groove is formed in a circular shape, with the guiding block convexly disposed at the center of the formation groove. Therefore, when the nail is fired along a radial direction, with the guiding block guiding the nail to move toward the formation groove which surrounds the guiding block, the firing direction of the nail is prevented from affecting the bending direction of the nail, such that the nail is bent to form the desired shape.

DETAILED DESCRIPTION OF THE INVENTION

Figure 1:
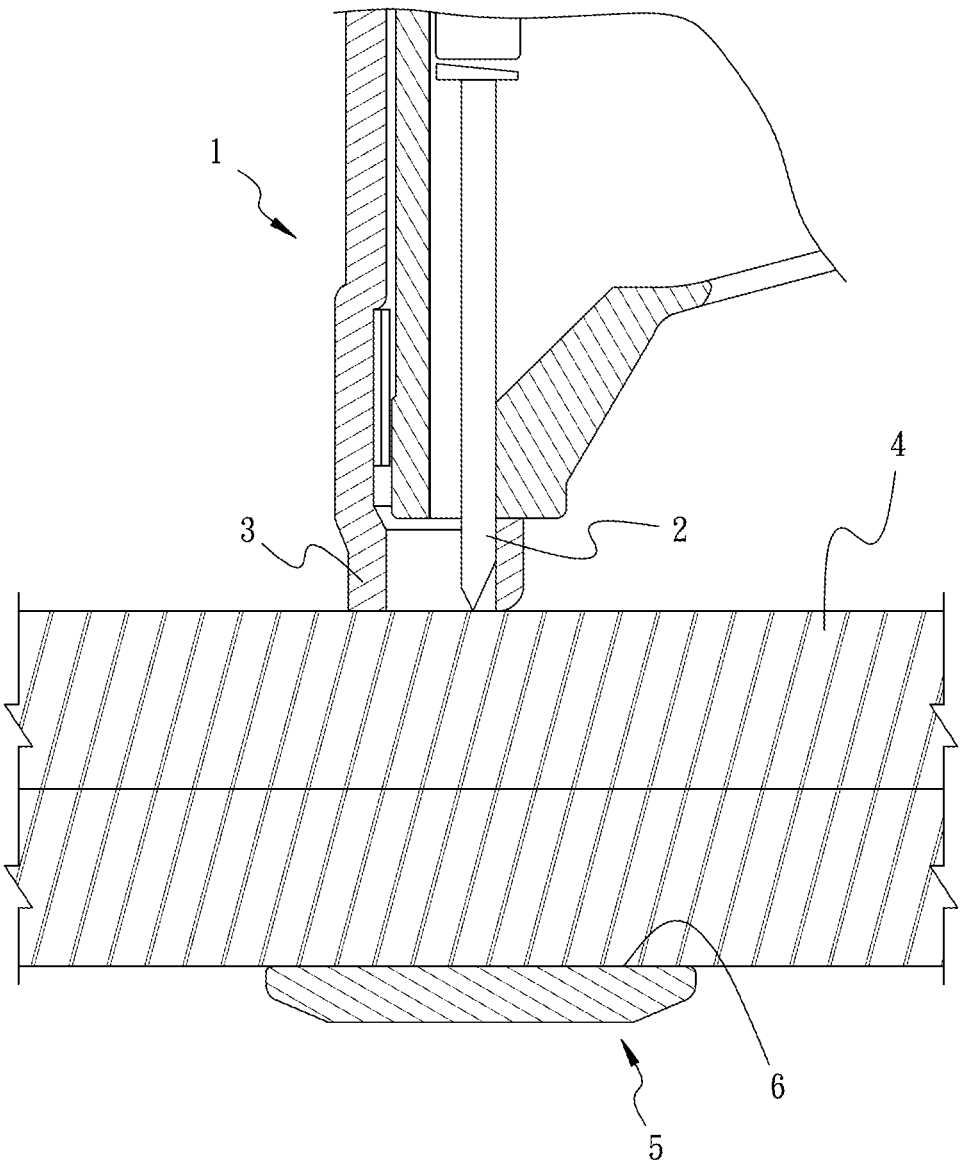
PRIOR ART FIG. 1
FIG. 1 is a schematic view illustrating a conventional nail blocking member applied with a nail gun.
Figure 2:
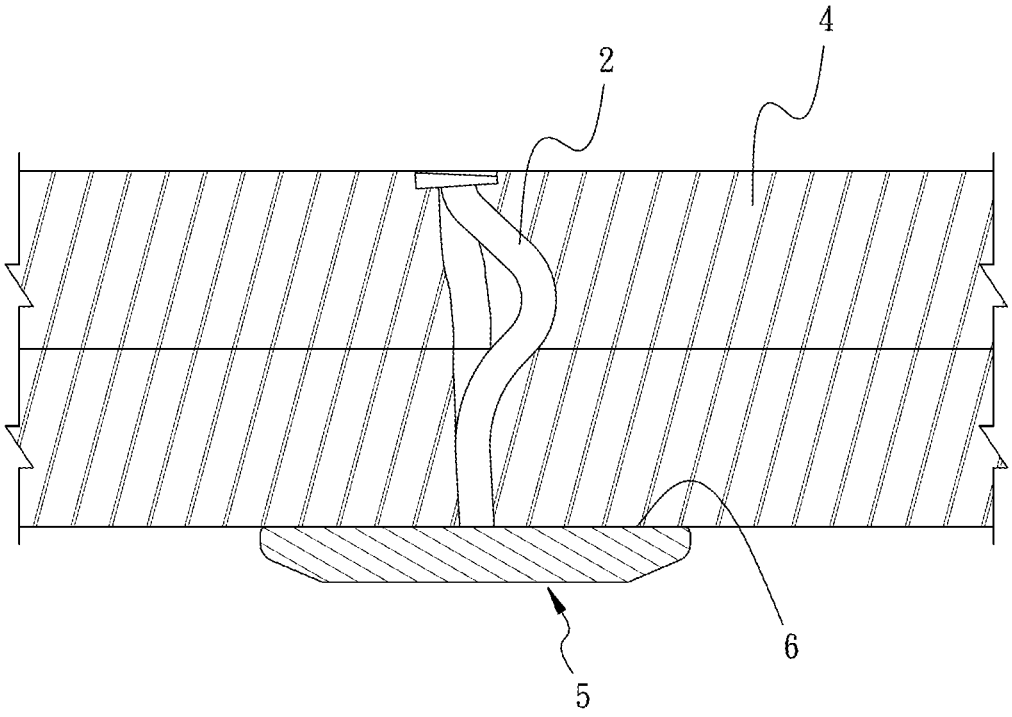
PRIOR ART FIG. 2
FIG. 2 is a schematic view illustrating a fired nail hitting the conventional nail blocking member.
Figure 3:
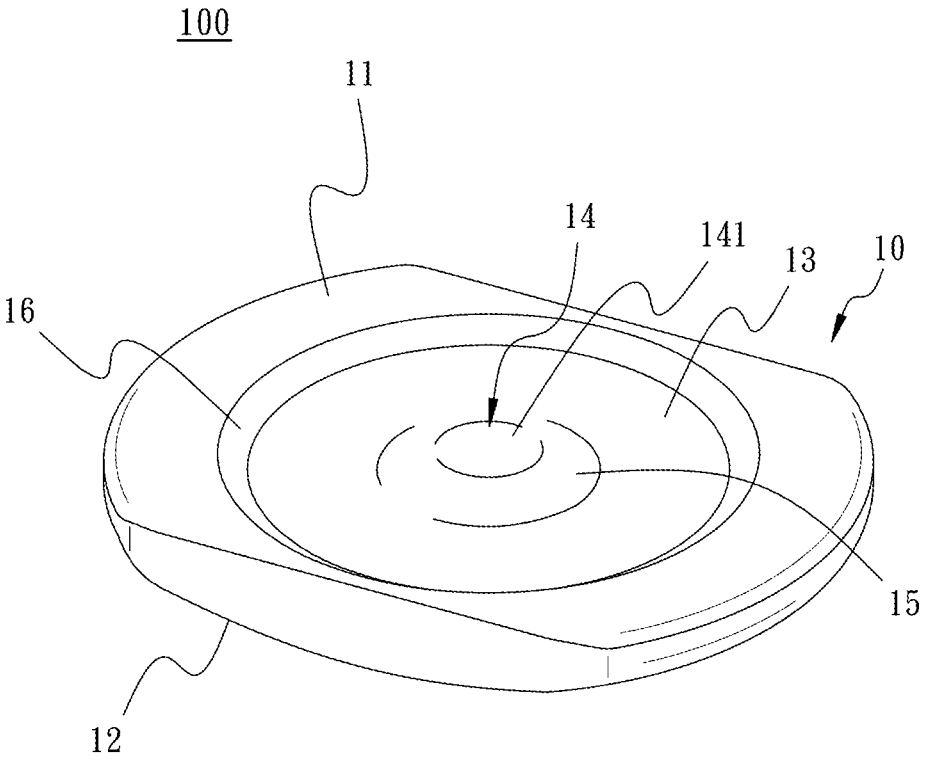
FIG. 3 is a perspective view of a nail blocking member in accordance with an embodiment of the present invention.
Figure 4:
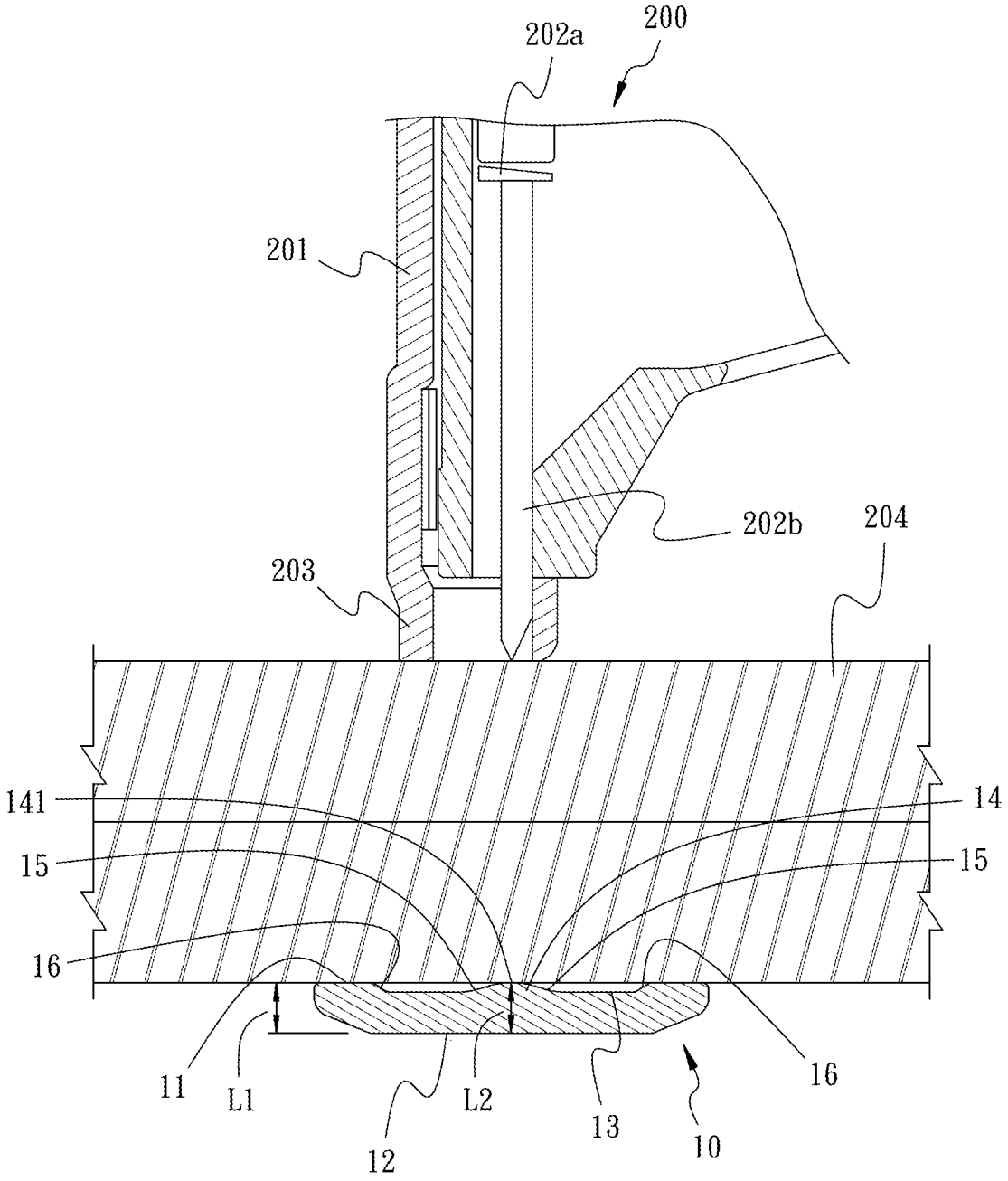
FIG. 4 is a schematic view illustrating the nail blocking member in accordance with an embodiment of the present invention applied with a nail gun.

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 3 to FIG. 6, an embodiment of the present invention provides a nail blocking member 100 for a nail gun 200. The nail gun 200 includes a gun head 201, a handle (not shown) and a nail magazine (not shown) connected with the gun head 201, a firing portion 203 disposed at one end of the gun head 201 for firing nails 202, and a trigger (not shown) disposed at one side of the gun head 201. The user grips the handle of the nail gun 200. The nail magazine contains a plurality of nails 202. The nail 202 includes a head end 202*a* and a tail end 202*b*. A cavity is disposed between the gun head 201 and the handle, such that the cavity is connected with a pressure source, allowing a compressed air to enter into the cavity.

When user needs to fire the nail 202 through an object 204, the nail blocking member 100 is placed on a plane, such as a table or the ground surface which is able to hold the nail blocking member 100, and presses the object 204 upon the nail blocking member 100 with the firing portion 203. Then, the user controls the trigger, driving the compressed air to strike the nail 202, such that the nail 202 is fired by the firing portion 203 to enter the object 204. As a result, the head end 202*a* of the nail 202 is stuck on the surface of the object 204, and the tail end 202*b* of the nail 202 passes through the object 204. The object 204 is allowed to be wood boards, stacked boards, or pallets.

The nail blocking member 100 of the present invention includes a main body 10.

The main body 10 includes a contact face 11 and a bottom face 12 disposed in opposite to the contact face 11. The contact face 11 includes a concave formation groove 13 having a plane-shaped groove bottom, with a guiding block protruding from the formation groove 13. In an embodiment of the present invention, the main body 10 is formed of a metal material. The contact face 11 is formed in a plane shape. The formation groove 13 is formed in an approximate circular shape. The guiding block 14 projects at the center of the formation groove 13, with the bottom face 12 of the guiding block 14 formed in an approximate circular shape and. In other words, the formation groove 13 is concavely formed around the guiding block 14, and the contact face 11 is convexly formed around the formation groove 13.

A guiding face 15 is disposed to be connected between the guiding block 14 and the formation groove 13. Also, the guiding face 15 is disposed inclined. Also, the guiding face 15 expands from the guiding block 14 toward the formation groove 13. The junction between the guiding face 15 and the formation groove 13 is formed in an arc shape. In an embodiment of the present invention, the junction between the guiding face 15 and the guiding block 14 is formed in an arc face, and the junction between the guiding face 15 and the formation groove 13 is formed in an arc face, wherein the arc face between the guiding face 15 and the guiding block 14 is larger than the arc face between the guiding face 15 and the formation groove 13.

A transition face 16 is disposed to be connected between the formation groove 13 and the contact face 11. Also, the transition face 16 is disposed inclined. Also, the transition face 16 expands from the contact face 11 toward the formation groove 13. In an embodiment of the present invention, the formation groove 13 and the transition face 16 include an obtuse angle, and the transition face 16 and the contact face 11 include an obtuse angle.

Figure 5:
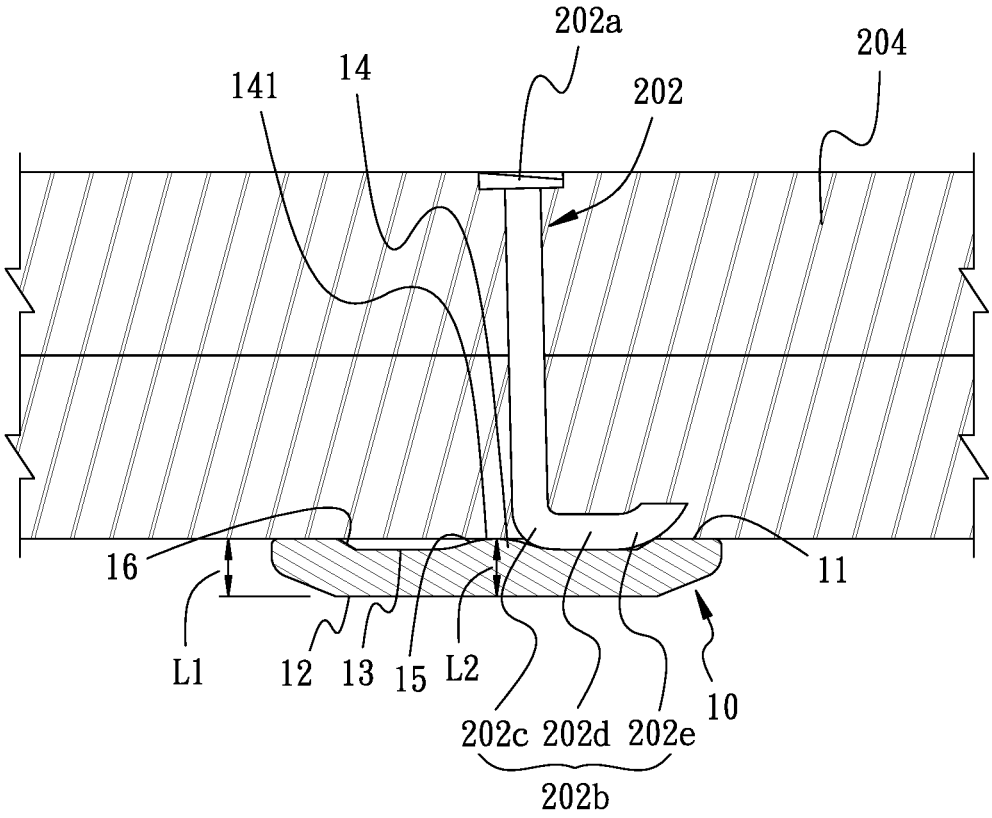
FIG. 5 is a schematic view illustrating a fired nail hitting the nail blocking member in accordance with an embodiment of the present invention.

When the object 204 is to be processed, the object 204 is pressed upon the contact face 11 by the firing portion 203. The user controls the trigger, so as to fire the nail 202 by the firing portion 203. The tail end 202*b* of the nail 202 passes through the object 204 and hits the top face 141 of the guiding block 14, such that the tail end 202*b* of the nail 202 is guided by the guiding face 15 to slide to the formation groove 13, whereby the tail end 202*b* of the nail 202 forms a first bent portion 202*c*. Because the firing portion 203 keeps pressing the object 204, the pressing force forces the tail end 202*b* of the nail 202 to be bent along the groove bottom of the groove 13, forming a straight section 202*d*, and the transition face 16 forces the tail end 202*b* of the nail 202 to form a second bent portion 202*e*, such that the tail end 202*b* of the nail 202 is folded back toward the object 204. Therefore, the nail 202 is bent into a J form, as shown by FIG. 5. Therein, the straight section 202*d* of the nail 202 is connected with the first bent portion 202*c* and the second bent portion 202*e* therebetween.

In addition, a distance from the bottom face 12 to the contact face 11 is defined as a first length L1; a distance from the bottom face 12 to the top face 141 of the guiding block 14 is defined as a second length L2; the first length L1 is larger than or equal to (not smaller than) the second length L2. In an embodiment of the present invention, the first length L1 is equal to the second length L2. When the first length L1 is larger than or equal to the second length L2, the object 204 is stably pressed upon the contact face 11 or upon the contact face 11 and the top face 141 of the guiding block 14. Therefore, upon firing the nail 202 by the firing portion 203, a gap is prevented from being generated between the contact face 11 and the object 204, so as to assure that the nail 202 is smoothly bent.

Figure 6:
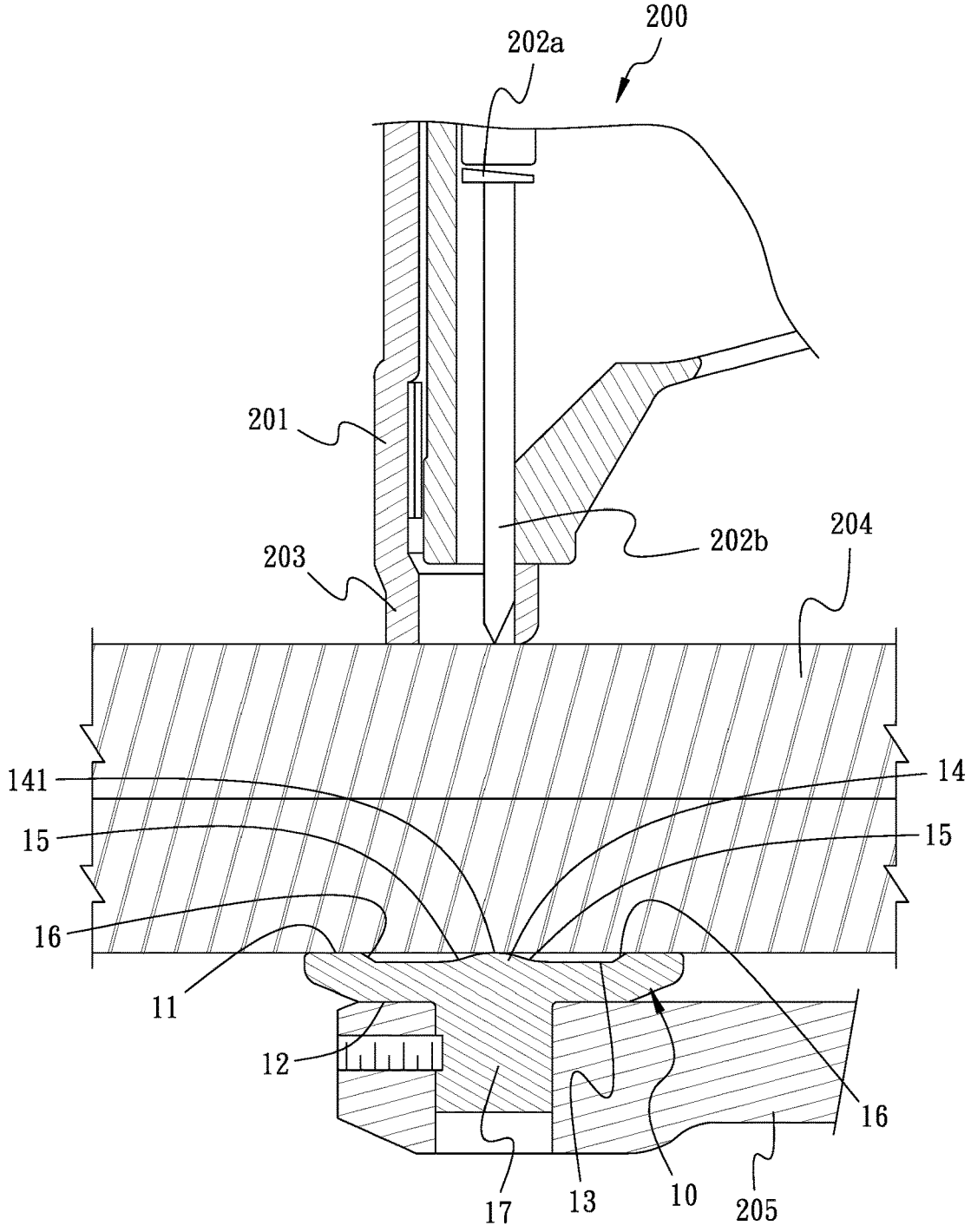
FIG. 6 is a schematic view illustrating the nail blocking member in accordance with an embodiment of the present invention connected with a nail gun.

In another embodiment of the present invention, referring to FIG. 6, the main body 10 includes a connection portion 17 which is convexly disposed at the bottom face 12. The connection portion 17 is connected with the clamp 205 of the nail gun 200. The contact face 11 faces the firing portion 203 of the nail gun 200. In an embodiment of the present invention, the main body 10 is fixed to one end of the clamp 205 of the nail gun 200 through the connection portion 17, wherein the clamp 205 of the nail gun 200 is allowed to pivot against the firing portion 203. When the clamp 205 moves away from the firing portion 203, the object 204 is optionally released from or placed between the main body 10 and the firing portion 203. When the clamp 205 moves toward the firing portion 203, the clamp 205 is allowed to clamp the object 204.

When the object 204 is to be processed, the object 204 is clamped by the clamp 205 and the firing portion 203 of the nail gun 200, such that the object 204 is pressed upon the contact face 11 by the firing portion 203. Then, the user controls the trigger to fire the nail 202 by the firing portion 203. The tail end 202*b* of the nail 202 passes through the object 204 and hits the top face 141 of the guiding block 14 and is further guided by the guiding face 15 to slide to the formation groove 13. As a result, the tail end 202*b* of the nail 202 is bent according to the shape of the formation groove 13, and is further folded back toward the object 204. Therefore, the nail 202 is bent into a J shape.

With the nail blocking member 100 of the present invention, when the nail 202 passes through the object 204 to hit the main body 10 of the nail blocking member 100, the nail 202 efficiently slides along the inclined guiding face 15 and the arc face conjunction to the formation groove 13, with the tail end 202*b* of the nail 202 being further folded back toward the object 204 through the transition face 16. Therefore, the nail 202 is smoothly bent into the desired J shape.

Furthermore, when the nail 202 is fired by the firing portion 203 along a radial direction, with the guiding face 15 disposed between the guiding block 14 and the formation groove 13 surrounding the guiding block 14, the nail 202 is allowed to be bent into the J shape without being affected by the random radial firing direction.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A nail blocking member for nail gun, the nail gun including a firing portion for firing a nail, the nail blocking member comprising:

a main body provided with a contact face, with a formation groove concavely disposed on the contact face, the formation groove having a plane-shaped groove bottom, and a guiding block protruding from the formation groove, a sloping guiding face connected between the guiding block and the formation groove, and a sloping transition face connected between the formation groove and the contact face;

wherein in operation, an object is pressed upon the contact face by the firing portion, and a nail is fired by the firing portion to enter the object to hit the guiding block, such that a tail end of the nail is guided by the guiding block to move from the guiding face toward the formation groove, such that the tail end forms a first bent portion; with the firing portion continuously pressing upon the object, a pressing force of the firing portion forces the tail end of the nail to be bent along the groove bottom of the groove, so as to form a straight section connected with the first bent portion, and the transition face then forces the tail end of the nail to form a second bent portion, whereby the tail end of the nail is bent back toward the object.

2. The nail blocking member of claim 1, wherein the guiding face expands from the guiding block toward the formation groove.

3. The nail blocking member of claim 2, wherein a junction between the guiding face and the guiding block is formed in an arc shape, and a junction between the guiding face and the formation groove is formed in an arc shape.

4. The nail blocking member of claim 1, wherein a junction between the guiding face and the guiding block is formed in an arc shape, and a junction between the guiding face and the formation groove is formed in an arc shape.

5. The nail blocking member of claim 1, wherein the transition face expands from the contact face toward the formation groove.

6. The nail blocking member of claim 1, wherein the formation groove is formed in a circular shape, and the guiding block is convexly disposed at a center of the formation groove.

7. The nail blocking member of claim 6, wherein a top face of the guiding block is formed in a circular shape.

8. The nail blocking member of claim 1, wherein the main body includes a bottom face disposed on one side of the main body in opposite to another side on which the contact face is disposed, with a distance between the bottom face to the contact face defined as a first length, a distance between the bottom face and a top face of the guiding block defined as a second length, the first length being not smaller than the second length.

9. The nail blocking member of claim 1, wherein the main body includes a bottom face and a connection portion disposed on one side of the main body in opposite to another side on which the contact face is disposed, the connection portion convexly formed on the bottom face, the connection portion connected with a clamp of the nail gun, the contact face facing the firing portion of the nail gun.

* * * * *